US005616212A

United States Patent [19]

Isobe

[11] Patent Number: 5,616,212

[45] Date of Patent: Apr. 1, 1997

[54] METHOD FOR POLISHING A WAFER BY SUPPLYING SURFACTANT TO THE REAR SURFACE OF THE WAFER

[75] Inventor: Akira Isobe, Tokyo, Japan

[73] Assignee: NEC Corporation, Japan

[21] Appl. No.: 590,124

[22] Filed: Jan. 23, 1996

[30] Foreign Application Priority Data

Jan. 25, 1995 [JP] Japan ..... 7-009835

[51] Int. Cl.[6] ..... H01L 21/306

[52] U.S. Cl. ..... 438/693; 216/88; 451/287; 451/289

[58] Field of Search ..... 156/636.1, 645.1; 216/88, 89, 90, 91; 451/287, 289

[56] References Cited

U.S. PATENT DOCUMENTS

| | | | |
|---|---|---|---|
| 4,156,619 | 5/1979 | Greisshammer | 134/2 |
| 4,184,908 | 1/1980 | Lackner et al. | 156/636.1 |
| 4,256,535 | 3/1981 | Banks | 156/645.1 |
| 4,373,991 | 2/1983 | Banks | 156/645.1 |
| 5,423,716 | 6/1995 | Strasbaugh | 451/289 |
| 5,449,316 | 9/1995 | Strasbaugh | 451/287 |
| 5,545,076 | 8/1996 | Yun et al. | 156/645.1 |
| 5,573,448 | 11/1996 | Nakazima et al. | 451/287 |

FOREIGN PATENT DOCUMENTS 0537627 4/1993 European Pat. Off. .

*Primary Examiner*—R. Bruce Breneman
*Assistant Examiner*—Anita Alanko
*Attorney, Agent, or Firm*—Hayes, Soloway, Hennessey, Grossman & Hage, P.C.

[57] ABSTRACT

In a wafer polishing method and a device therefor, a surfactant solution is applied to the rear of a wafer by spraying or immersion before the wafer is attached to a holder. Even when the rear of the wafer is hydrophobic, it does not repel the solution and can be entirely covered therewith. Hence, it is possible to enhance the even polishing of the wafer while insuring the holding of the wafer. In addition, particles left on the wafer after polishing are easily removed in a cleaning step to follow.

5 Claims, 6 Drawing Sheets

Fig. 6

| METHOD | EVENNESS ($\sigma$) |
|---|---|
| 1ST EMBODIMENT | 3.6 % |
| 2ND EMBODIMENT | 3.8 % |
| PRIOR ART | 9.8 % |

Fig. 7

| METHOD | PARTICLES ON FRONT | PARTICLES ON REAR |
|---|---|---|
| 1ST EMBODIMENT | ~ 100 | ~ 500 |
| 2ND EMBODIMENT | ~ 80 | ~ 500 |
| 3RD EMBODIMENT | ~ 50 | > 10000 |
| 4TH EMBODIMENT | ~ 50 | ~ 500 |
| 2ND & 4TH EMBODIMENTS | ~ 30 | ~ 200 |
| PRIOR ART | ~ 100 | > 10000 |

METHOD FOR POLISHING A WAFER BY SUPPLYING SURFACTANT TO THE REAR SURFACE OF THE WAFER

BACKGROUND OF THE INVENTION

The present invention relates to a method of polishing the irregular front of a wafer or semiconductor substrate, and a device therefor. More particularly, the present invention is concerned with a wafer polishing method which polishes the front of a wafer while holding the rear of the wafer in close contact with a backing, and a device therefor.

It is a common practice with a semiconductor production line to polish and thereby flatten the irregular front of a wafer or semiconductor substrate which is ascribable to a diffusing step. This kind of polishing is comparable with mirror polishing used to polish a semiconductor substrate produced by slicing a semiconductor crystal member. However, these polishing schemes are noticeably different from each other when it comes to the required polishing ability. Although mirror polishing attaches importance to surface roughness, control of the order of microns suffices as to the amount of polishing of the crystal substrate and the distribution of polishing in a plane. By contrast, the amount of polishing and the distribution thereof in a plane are critical with the other polishing scheme, i.e., flattening, and must be controlled by the order of tens to hundreds of angstroms. Further, because cleaning to follow mirror polishing is free from strict limitations, a broad range of cleaning liquids are usable. In the case of the polishing following the diffusing step, only a limited group of cleaning liquids are usable because films of various substances exist on the wafer beforehand. It has been customary with this kind of polishing or flattening to use mechanical cleaning relying on a brush scrubber.

While various kinds of approaches have been proposed in the past in order to flatten the irregular front of the wafer by polishing it, they cannot provide the front with a sufficient degree of evenness and make it difficult to remove particles in the cleaning step to follow the polishing step.

SUMMARY OF THE INVENTION

It is therefore an object of the present invention to provide a wafer polishing method which provides the polished front of a wafer with desirable evenness by enhancing the sure holding of the wafer without regard to the condition of the rear thereof, while facilitating the removal of particles after polishing, and a device therefor.

In accordance with the present invention, a method of flattening the irregular front of a wafer which is a semiconductor substrate has the steps of (a) attaching the rear of the wafer to a holder by causing the rear to closely contact a backing included in the holder, (b) pressing the front of the wafer against a turn table to thereby polish and flatten the front, and (c) wetting, prior to the step (a), the rear of the wafer with a surfactant solution.

Also, in accordance with the present invention, a device for flattening the irregular front of a wafer which is a semiconductor substrate has a holder for holding the rear of the wafer closely contacting the holder, and including a backing. A loader conveys the wafer to the holder. A surfactant solution is fed to the rear of the wafer. The front of the wafer is pressed against a turn table to be polished thereby. An unloader receives the polished wafer from the holder.

BRIEF DESCRIPTION OF THE DRAWINGS

The above and other objects, features and advantages of the present invention will become more apparent from the following detailed description taken with the accompanying drawings in which:

FIG. 6 is a table comparing the evenness of a polished front achievable with the present invention and the evenness available with the conventional device; and FIG. 7 is a table comparing the present invention and the conventional device with respect to the number of particles left on a wafer after a cleaning step.

DESCRIPTION OF THE PREFERRED EMBODIMENTS

Figure 1A:
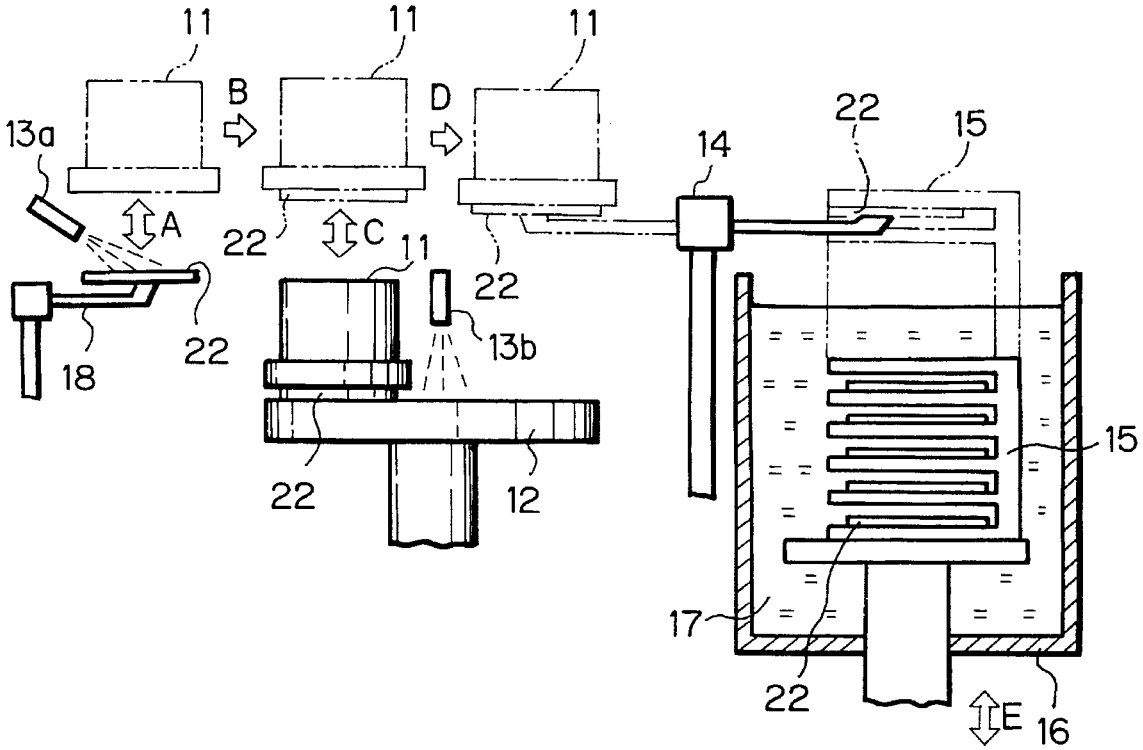
Fig. 1A PRIOR ART
FIG. 1A shows a conventional wafer polishing device.

To better understand the present invention, a brief reference will be made to a conventional wafer polishing device, shown in FIG. 1A. As shown, the device has a holder 11 for holding a wafer 22, a turn table 12 for polishing the water 22 held by the holder 11, a nozzle 13*a* for spraying water onto the rear of the wafer 22 prior to polishing, and a nozzle 13*b* for feeding a slurry to the water 22 being polished. Arranged around the polishing device are a loader 18, an unloader 14, a wafer cassette 15, and a tank 16 filled with pure water 17. The loader 18 picks the wafer 22 out of a water cassette, not shown, and retains the wafer 22 face down. The wafer 22 polished is transferred from the holder 11 to the unloader 14 and then brought into the wafer cassette 15 by the unloader 14. When the cassette 15 received the wafer 22 is lowered into the tank 16, the water 22 is immersed in the pure water 17.

Figure 1B:
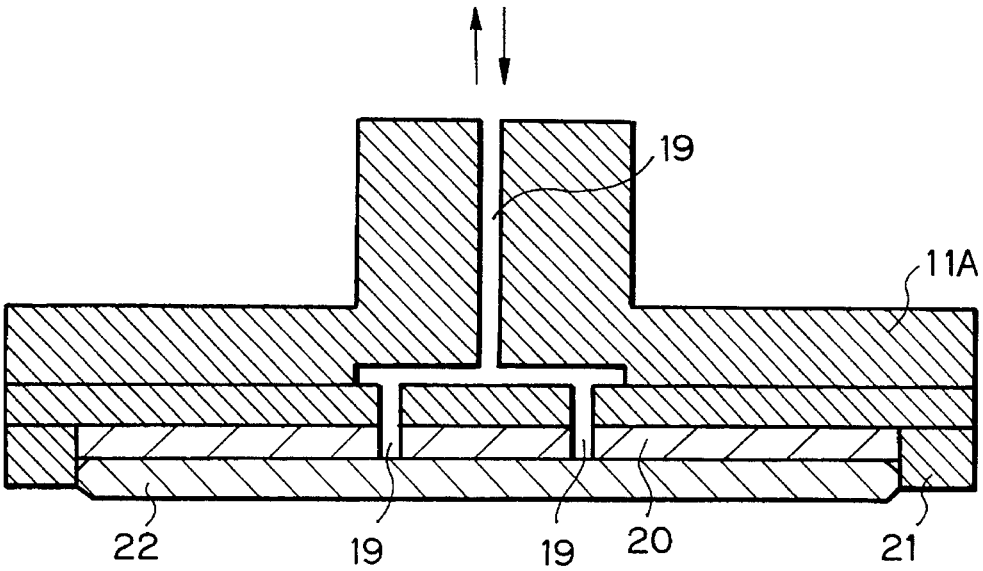
Fig. 1B PRIOR ART
FIG. 1B is a section showing a holder included in the conventional device of FIG. 1A.

As shown in FIG. 1B, the holder 11 has a body 11A formed with a passageway 19 for setting up vacuum by the evacuation of air or cancelling it by the feed of air. A retainer ring 21 is fitted on the underside of the body 11A in order to prevent the wafer 22 from coming off during polishing. A backing 20 is also mounted on the underside of the body 11A. The backing 20 has a suction surface which contacts the wafer 22. Specifically, the backing 20 is implemented as a porous film and causes the wafer 22 to adhere thereto by wetting. Usually, for the backing 20, use is made of, e.g., R200 (trade name) available from Rodel.

In operation, as shown in FIG. 1A, the loader 18 picks the wafer 22 out of the wafer cassette, not shown, and conveys it to a position beneath the holder 11. Then, water is sprayed from the nozzle 13*a* so as to wet the rear of the wafer 22. Subsequently, the holder 11 is lowered, as indicated by an arrow A, in order to suck and hold the wafer 22. The holder 11 holding the wafer 22 is again raised in the direction A. At this instant, if the rear of the wafer 22 is not wet, the sealability of the holder 11 as to the vacuum in the passageway 19 is deteriorated and is apt to cause the holder 11 to drop the wafer 22.

The holder 11 raised away from the loader 18 is moved over the turn table 12 in a direction B and then lowered in a direction C until the water 22 has been pressed against the table 4. In this condition, the table 4 is rotated to polish the front of the wafer 22 with the slurry being fed from the nozzle 13*b*. At this instant, air is introduced into the passageway 19 in order to cancel the vacuum. As a result, the wafer 22 is retained only by the adhesion acting between the backing 20 and the rear of the wafer 22. Hence, if the rear of the wafer 22 is not sufficiently wet, the adhesion is lowered with the result that the backing 20 cannot surely hold the wafer 22. Air under pressure may be fed into the passageway 19 during the course of polishing, so that an air pressure acts on the wafer 22. The air pressure will convex the wafer 22 downward and will thereby increase the polishing rate at the central portion of the wafer 22, which is apt to be lower than the other portion. However, if the rear of the wafer 22 is not sufficiently wet, the above pressure leaks due to the fall of sealability and prevents the expected even polishing from being achieved.

After the polishing step, the holder 11 is raised away from the turn table 12 in the direction C and then moved toward the unloader 14 in a direction D. As a result, the wafer 22 is transferred from the holder 11 to the unloader 14. Subsequently, the unloader 14 is turned to bring the wafer 22 into the wafer cassette 15. The cassette 15 with the wafer 22 is lowered by an elevator mechanism, not shown, in a direction E, so that the water 22 is immersed in the pure water 17 filling the tank 16. The cassette 15 is elevated into the air only when the wafer 22 is transferred from the unloader 14 to the cassette 15. This is because if the wafer 22 is dried, it is extremely difficult to remove particles from the wafer 22 in a cleaning step to follow.

The above conventional device has various problems stemming from the fact that wettability depends on the condition of the rear of the wafer 22. For example, if the rear of the wafer 22 is hydrophobic, it repels water and prevents it from being sufficiently spread between the wafer 22 and the backing 20, resulting in low sealability. This prevents the holder 11 from stably holding the wafer 22 and thereby obstructs the even polishing of the front of the wafer 22. Further, the hydrophobic rear of the wafer 22 repels water even after the polishing step, and therefore makes it difficult to remove particles from the rear in the cleaning step. Specifically, although the polished wafer 22 is immersed in the pure water 17 in the tank 16, it is again exposed to the air and repels the water immediately when the cassette 15 is raised in the event of unloading.

As stated above, the prerequisites with polishing are enhancing the even polishing of the wafer 22 and the easy removal of particles from the wafer 22. However, when the surface of, e.g., a wafer on which a silicon oxide film is formed is polished, the removal of particles is deteriorated although its surface is not hydrophobic and can be evenly polished.

Figure 2:
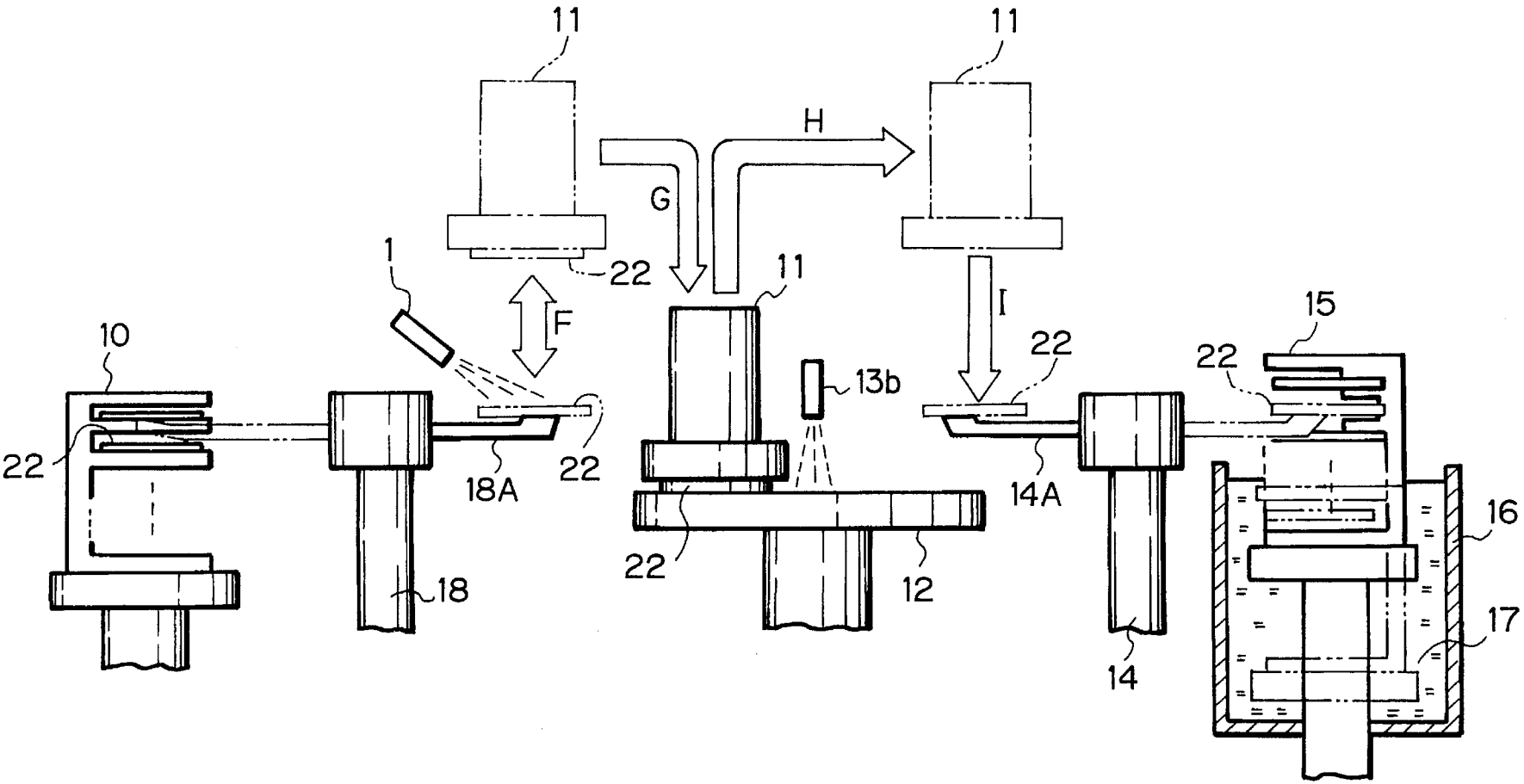
FIGS. 2–5 respectively show a first embodiment to a fourth embodiment of the wafer polishing device in accordance with the present invention.

Referring to FIG. 2, a first embodiment of the wafer polishing device in accordance with the present invention is shown. In FIG. 2, the same or similar constituents as or to the constituents shown in FIGS. 1A and 1B are designated by the same reference numerals. As shown, the polishing device has a loader 18 for picking a wafer 22 out of a wafer cassette 10 and holding it face down. A turn table polishes the wafer 22. A holder 11 holds the wafer 22 transferred thereto from the loader 18 and presses it against a turn table 12. The holder 11 has a configuration substantially similar to the configuration shown in FIG. 1B. The wafer 22 polished is transferred from the holder 11 to the unloader 14 and then brought into a wafer cassette 15 by the unloader 14. When the cassette 15 received the wafer 22 is lowered into a tank 16, the wafer 22 is immersed in pure water 17 stored in the tank 16. The construction described so far is similar to the construction of the conventional device. The illustrative embodiment additionally includes a nozzle 1 for spraying a surfactant solution onto the rear of the wafer 22.

In operation, the loader 18 picks the wafer 22 out of the cassette 10, and then an arm 18A thereof is turned to convey the wafer 22 to beneath the holder 11. At this instant, the wafer 22 is held by the loader 18 such that its rear faces upward. Subsequently, the surfactant solution is fed from the nozzle 1 in order to wet the rear of the wafer 22. Even if the rear of the wafer 22 is hydrophobic, it does not repel the solution. As a result, the solution entirely covers the rear of the wafer 22.

Many kinds of surfactants are available and generally classified into hydrocarbon-based surfactants and fluorine-based surfactants. It is desirable with the embodiment to use a hydrocarbon-based surfactant, e.g., alkyldiphenylether disulphonate or polyoxyethylene ester oleate. This is because a fluorine-based surfactant is generally adsorbed by a surface and renders the surface water-repellent, i.e., it is apt to obstruct the removal of particles. Of course, any kind of surfactant is usable so long as it achieves the above object.

The holder 11 is lowered in a direction F so as to suck the wafer 22 positioned on the arm 18A. Because the rear of the wafer 22 is sufficiently wet by the surfactant solution, the sealability for insuring vacuum suction is not deteriorated. Hence, the holder 11 can surely hold the wafer 22. The holder 11 carrying the wafer 22 therewith is moved over the table 12 in a direction G and then lowered until the wafer 22 has been pressed against the table 12. The table 12 in rotation polishes the front of the wafer 22 with a slurry being fed from the nozzle 13*b*. At this instant, the vacuum set up via the passageway 19, FIG. 1B, is cancelled, so that the wafer 22 is held only by the adhesion acting between the backing 20, FIG. 1B, and the rear of the wafer 22. The rear of the wafer 22 sufficiently wet by the surfactant solution surely adheres to the backing 20. Further, when the previously mentioned air pressure is applied to the rear of the wafer 22 via the passageway, FIG. 1B, in order to implement even polishing, it is prevented from leaking because of the sufficiently wet rear of the wafer 22. Hence, the air pressure presses the rear of the wafer 22 downward in a uniform distribution, thereby promoting the even polishing of the front of the wafer 22.

After the polishing step, the holder 11 is raised away from the table 18 in a direction H and then lowered in a direction I so as to transfer the polished wafer 22 to an arm 14A included in the unloader 14. Subsequently, the arm 14A is turned to bring the wafer 22 into the cassette 15 which has been elevated out of the pure water 17. The cassette 15 received the wafer 22 therein is lowered by the elevator mechanism, not shown. As a result the wafer 22 is immersed in the pure water 17 stored in the tank 16. The cassette 15 is raised into the air in the event of the transfer of the wafer 22 from the arm 14A to the cassette 15, but it is again lowered into the pure water 17 immediately after the receipt of the wafer 22. Hence, the rear of the wafer 22 remains wet even during the conveyance. In addition, the rear of the wafer 22 is prevented from drying in the cassette 15 because the cassette 15 is immersed in the pure water 17. This insures the removal of particles in a cleaning step to follow.

Figure 3:
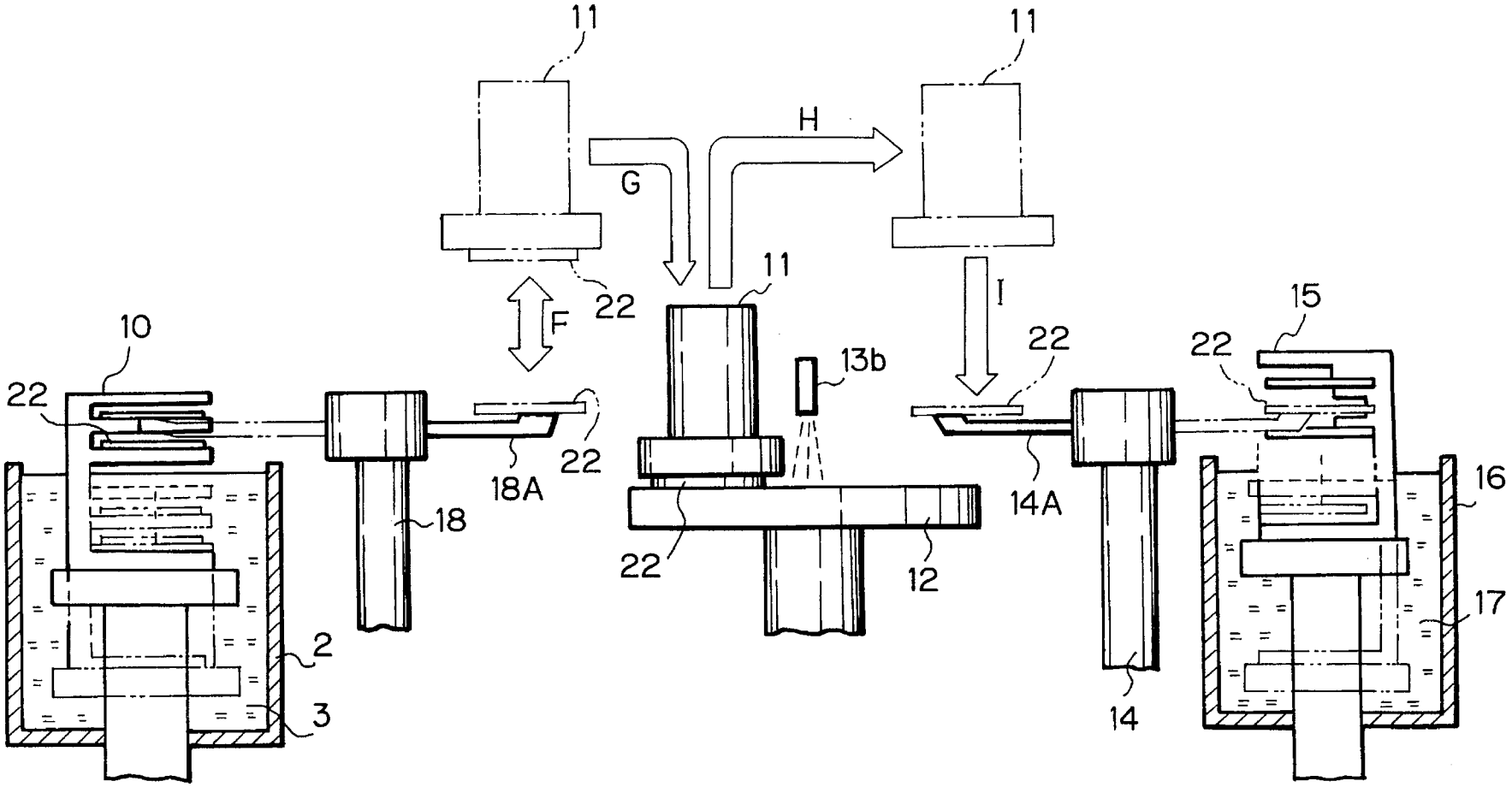

FIG. 3 shows a second embodiment of the present invention. As shown, the surfactant nozzle 1 of the previous embodiment is replaced with a tank 2 storing a surfactant solution 3. The wafer cassette 10 storing wafers 22 is elevatably immersed in the surfactant solution 3. While the nozzle 1 of the previous embodiment is likely to fail to fully wet the rear of the wafer 22 due to stopping or dislocation thereof, the cassette 10 of this embodiment is bodily immersed in the solution 3 and thereby obviates such an occurrence. Moreover, this embodiment makes it needless for the solution to be sprayed onto the rear of the wafer 22 by the nozzle 1; that is, the cassette 10 storing the wafer 22 should only be immersed in the solution 3 filling the tank 2, thereby saving time.

Figure 4:
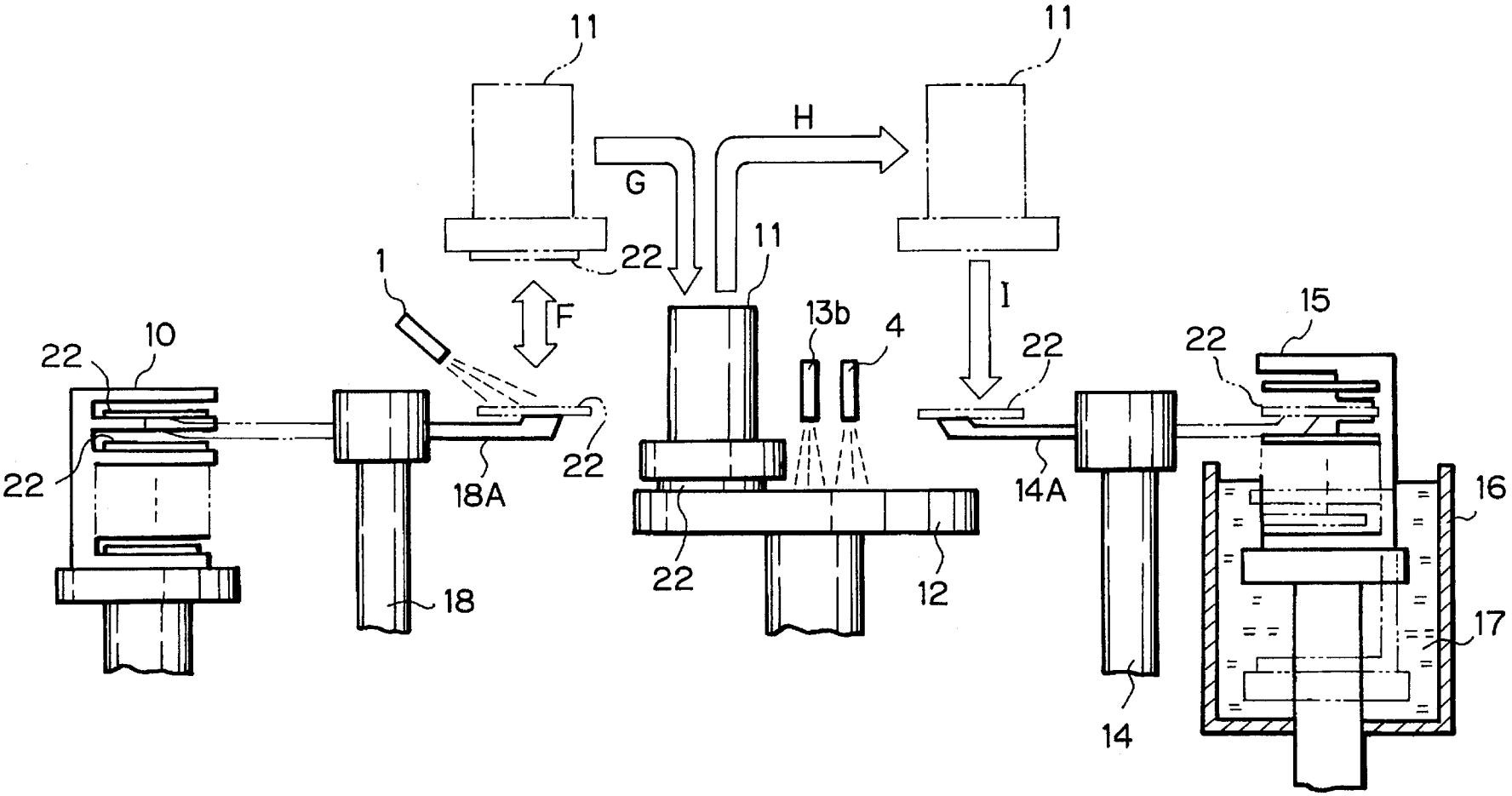

A third embodiment of the present invention will be described with reference to FIG. 4. As shown, this embodiment is similar to the first embodiment except that it has, in addition to the nozzle 1 for spraying the surfactant solution onto the rear of the wafer 22, a nozzle 4 positioned next to the slurry nozzle **13*b* in order to feed the surfactant solution. In this construction, the solution is fed from the nozzle 4 onto the table 12 together with the slurry or polishing liquid during the course of polishing. As a result, the rear of the wafer 22 is covered with the surfactant as soon as the front of the wafer 22 is fully polished. This allows the wafer 22 to be surely held and promotes the efficient removal of particles from the front of the wafer 22** in a cleaning step to follow.

Figure 5:
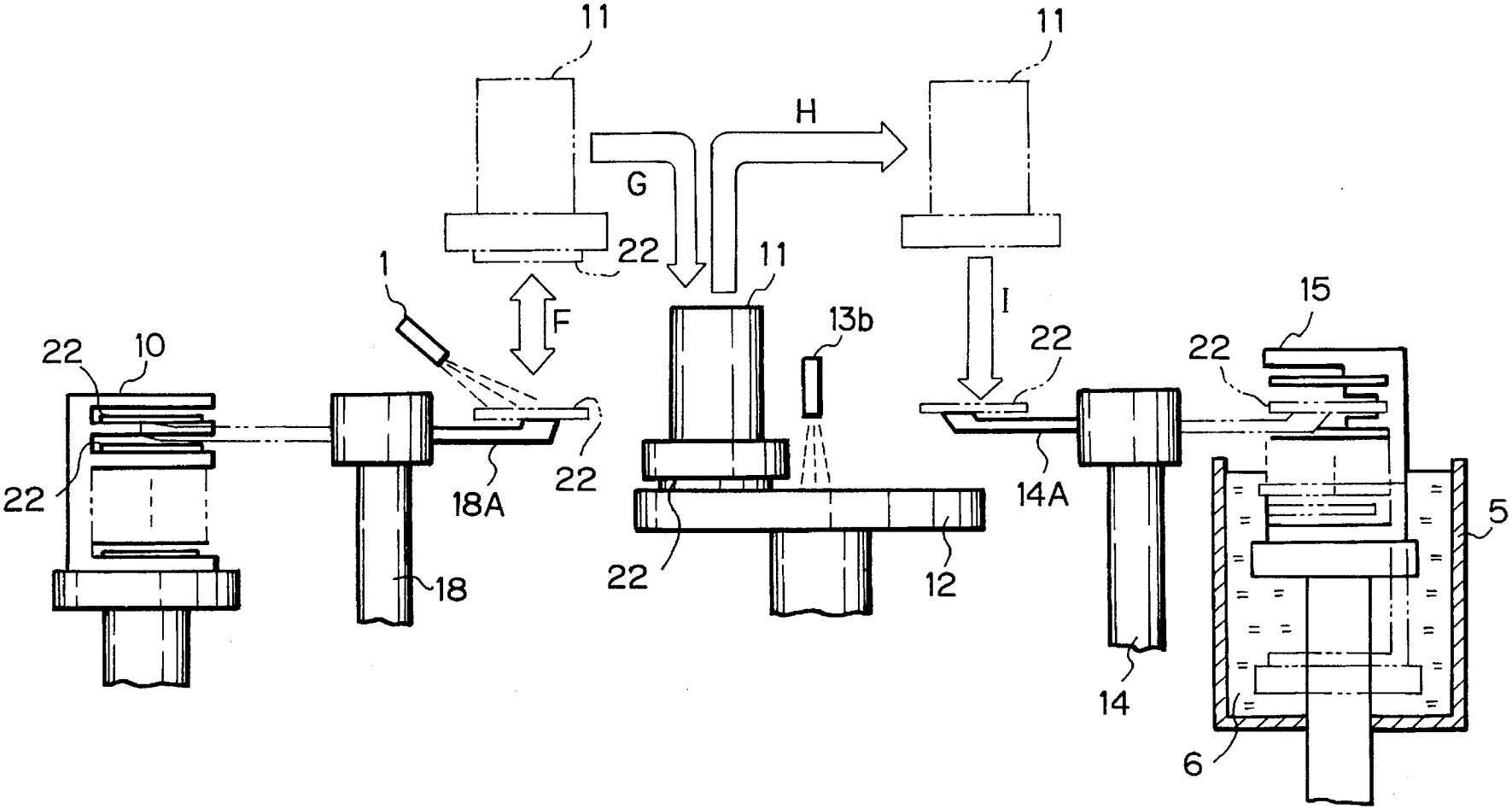

FIG. 5 shows a fourth embodiment of the present invention. As shown, this embodiment is identical with the first embodiment except that the tank 16 filled with the pure water 17 is replaced with a tank 5 filled with a surfactant solution 6. The cassette 15 received the polished wafer 22 from the unloader 14 is immersed in the surfactant solution 6. Hence, although the wafer 22 is exposed to the air when it is conveyed to a cleaning station, the front and rear of the wafer 22 both remain wet due to the solution. This further promotes the easy removal of particles from the wafer 22.

FIG. 6 compares the polishing device of the present invention with the conventional polishing device with respect to the even polishing of the front of the wafer 22. Specifically, for experiments, 6-inch wafers were each subjected to plasma CVD (Chemical Vapor Deposition) to grow a 1 μm thick silicon oxide film thereon. As a result, each water 22 was provided with a hydrophorbic rear. The resulting wafers 22 were each polished by about 0.5 μm by one of the above first and second embodiments and conventional device. Subsequently, each wafer 22 was measured at its forty-nine points over the range of 10 mm so as to determine the evenness of polishing σ. As FIG. 6 indicates, the first and second embodiments provide the wafers with a desirable degree of evenness while the evenness available with the conventional device is limited.

FIG. 7 lists the numbers of particles left on wafers respectively polished by the first to fourth embodiments, the combination of the second and fourth embodiments, and the conventional device. Specifically, FIG. 7 shows the numbers of particles left on the front and rear of each wafer and determined by experiments. Regarding the rear of the wafer, the wafer was turned upside down so as to count particles existing on the mirror surface. As to the front of the wafer, a 0.3 μm silicon oxide film was formed by thermal oxidation, and then the front was polished to 0.15 μm in order to count particles. For cleaning, use was made of a cylindrical brush scrubber. To count the remaining particles, a laser waste testing device was used. The evaluation was effected on the basis of the number of remaining particles whose diameters were 0.2 μm and above.

As shown in FIG. 7, the first, second and fourth embodiments each reduces the number of particles remaining on the rear to 500 while the conventional device causes more than 10,000 particles to remain thereon. The third embodiment is as poor as the conventional device so long as the rear is concerned. As for the particles remaining on the front, while the first and second embodiments are not so advantageous over the conventional device, the third and fourth embodiments are far smaller than the conventional device. The combination of the second and fourth embodiments further reduces both the number of particles remaining on the front and the number of particles remaining on the rear.

In summary, in accordance with the present invention, a surfactant solution is applied to the rear of a wafer by spraying or immersion before the wafer is attached to a holder. Even when the rear of the wafer is hydrophobic, it does not repel the solution and can be entirely covered therewith. Hence, it is possible to enhance the even polishing of the wafer while insuring the holding of the wafer. Moreover, because the front and rear of the wafer are constantly wet due to the solution, the wafer is prevented from being exposed to the air and dried thereby even after a polishing step. This promotes the efficient removal of particles from the rear of the wafer in a cleaning step which follows the polishing step.

Various modifications will become possible for those skilled in the art after receiving the teachings of the present disclosure without departing from the scope thereof.

What is claimed is:

1. A method of flattening an irregular front of a wafer which is a semiconductor substrate, comprising the steps of:

(a) attaching a rear of the wafer to a holder by causing the rear to closely contact a backing included in said holder;

(b) pressing the front of the wafer against a turn table to thereby polish and flatten the front; and (c) wetting, prior to step (a), the rear of the wafer with a surfactant solution.

2. A method as claimed in claim 1, further comprising (d) wetting, prior to (b), the front of the wafer with the surfactant solution.

3. A method as claimed in claim 2, wherein steps (c) and (d) each comprises spraying the surfactant solution.

4. A method as claimed in claim 2, wherein steps (c) and (d) each comprises causing the surfactant solution to flow onto said turn table.

5. A method as claimed in claim 2, wherein steps (c) and (d) each comprises immersing the wafer in the surfactant solution.

* * * * *